US012617518B2

(12) United States Patent
Bø et al.

(10) Patent No.: US 12,617,518 B2
(45) Date of Patent: May 5, 2026

(54) VAPOUR TRANSFER ASSEMBLY AND METHOD FOR USE THEREOF

(71) Applicant: GBA Marine AS, Kolbjørnsvik (NO)

(72) Inventors: Rune Bø, Arendal (NO); Helge K. Aasen, Kolbjørnsvik (NO)

(73) Assignee: GBA Marine AS, Kolbjørnsvik (NO)

( * ) Notice: Subject to any disclaimer, the term of this patent is extended or adjusted under 35 U.S.C. 154(b) by 95 days.

(21) Appl. No.: 18/693,308

(22) PCT Filed: Sep. 16, 2022

(86) PCT No.: PCT/NO2022/050213
§ 371 (c)(1),
(2) Date: Mar. 19, 2024

(87) PCT Pub. No.: WO2023/048576
PCT Pub. Date: Mar. 30, 2023

(65) Prior Publication Data

US 2024/0391578 A1 Nov. 28, 2024

(30) Foreign Application Priority Data

Sep. 21, 2021 (NO) ..... 20211132

(51) Int. Cl.
*B63J 2/10* (2006.01)
*B63B 25/14* (2006.01)
*B63B 27/25* (2006.01)

(52) U.S. Cl.
CPC ..... *B63J 2/10* (2013.01); *B63B 25/14* (2013.01); *B63B 27/25* (2013.01)

(58) Field of Classification Search
CPC . B63J 2/10; B63B 25/14; B63B 27/25; B63B 57/04
See application file for complete search history.

(56) References Cited

U.S. PATENT DOCUMENTS 4,144,829 A 3/1979 Conway
5,125,439 A 6/1992 Perkins
5,398,629 A * 3/1995 Wasenius ..... B63B 25/082 114/211

FOREIGN PATENT DOCUMENTS

GB 209166 1/1924
GB 1318204 5/1973
(Continued)

OTHER PUBLICATIONS

International Search Report and Written Opinion mailed Jan. 3, 2023 for International Patent Application No. PCT/NO2022/050213.

(Continued)

*Primary Examiner* — Jason K Niesz
(74) *Attorney, Agent, or Firm* — Alix, Yale & Ristas, LLP

(57) ABSTRACT

Vapour transfer assembly for a plurality of oil tanks being connected to a common ventilation pipe to allow the atmosphere to be displaced from the tanks to avoid excessive pressure build-up in the tanks. The tanks are grouped into clusters of tanks comprising at least two tanks. A vapour transfer conduit from at least a first tank of such cluster of tanks is connected to a second tank of same cluster causing the atmosphere displaced from the first tank of the cluster of tanks to move through at least the second tank of said cluster of tanks before entering a common ventilation pipe. Thereby, a slower concentration build-up of volatile organic compounds in the atmosphere entering the common ventilation pipe is obtained. A method for loading such tanks is also contemplated.

13 Claims, 6 Drawing Sheets

(56) References Cited

FOREIGN PATENT DOCUMENTS

| | | | |
|---|---|---|---|
| NO | 333269 | B1 | 4/2013 |
| WO | 9220571 | A1 | 11/1992 |

OTHER PUBLICATIONS

International Preliminary Report on Patentability dated Oct. 30, 2023 for International Patent Application No. PCT/NO2022/050213.

* cited by examiner

VAPOUR TRANSFER ASSEMBLY AND METHOD FOR USE THEREOF

BACKGROUND

The disclosed embodiments concern a vapour transfer assembly and a method for loading oil to tank ships in a manner which reduces emittance of oil vapour (Volatile Organic Compounds, or VOC) to the atmosphere.

During loading of oil tankers, existing atmosphere in the cargo tanks is displaced by the inflowing oil. Even if the atmosphere in the cargo tanks may be pure inert gas at the start-up of loading, it will over the course of loading be combined with an increasing amount of oil vapour. This atmosphere must be released to maintain a pressure within design limits of the cargo tank design criteria.

Maintaining a slight overpressure in the cargo tank atmosphere is a mandatory feature in all tank ships transporting oil to prevent intrusion of oxygen into the cargo tanks, which could make the gas composition explosive. All cargo tanks are connected to a common ventilation assembly, and the atmosphere is eventually released though a common ventilation mast. An adjustable valve in the ventilation mast is used to affect tank atmosphere pressure in the cargo tanks irrespective of which tank receives oil at a certain point in time to keep this slight overpressure throughout the cargo loading.

Increasing pressure in the cargo tanks is a simple and well documented way of reducing vapor release from the oil, and some vessels are therefore also using this adjustable valve to increase tank pressure beyond the minimum requirement.

An oil tanker typically contains 12 cargo tanks arranged as six pairs in the length direction of the ship. Other cargo tank configurations are also common, but for simplicity the described arrangement as shown in FIG. 1 is used as example in this document. During loading, the left and the right tank of a pair will typically be filled simultaneously. Also typically, when a pair of tanks is filled, the adjacent pair is temporarily omitted, i.e., every second tank pair is filled at the same time. A typical sequence could be to fill pair P1, pair P3 and pair P5 simultaneously, then filling pair P2, pair P4 and pair P6 simultaneously.

SUMMARY

It would thus be useful to have a method and/or an assembly for loading cargo to oil tankers that reduces the inconvenience of oil vapour release to the environment.

As used herein, a "cluster of tanks" refers to two or more tanks fluidly connected in a manner allowing displacement of vapour between the individual tanks in each cluster in a manner defined as the assembly. The cluster or clusters may comprise two or more tanks, and for simplicity in the following detailed explanation, we mostly concentrate on clusters of two tanks.

While it is most convenient and provides the best effect that all the cargo tanks of a ship belong to a cluster in the sense described herein, it is not a requirement of the disclosed embodiments. While it for practical purposes is most convenient that all clusters are of the same size, this is neither a requirement of the disclosed embodiments. Thus, a ship of 12 cargo tanks may have the tanks organized as six clusters of two tanks, four clusters of three tanks, three clusters of four tanks, or even, for instance, two clusters of four tanks, and two clusters of two tanks.

BRIEF DESCRIPTION OF THE DRAWINGS

The invention is described in further detail in the following in the form of exemplary embodiments illustrated by drawings, where.

DETAILED DESCRIPTION

In the following description, a number of indices are used. For the tanks, we typically use the designation T1, T2, etc. For the last tank of a cluster of more than two tanks, we use the designation TL. For a non-specific tank (any tank), we use the designation TA. For clusters of tanks, we use the designation C1, C2 for the first and second cluster, etc. For a non-specific cluster we may use the designation CA.

Figure 1:
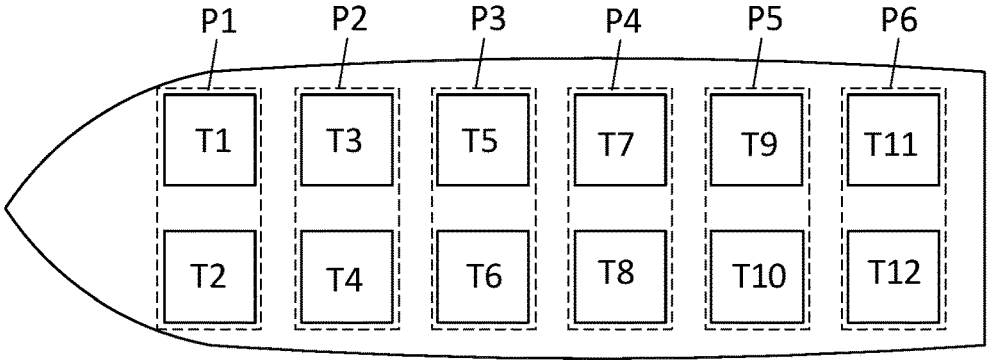
FIG. 1 is a schematic top view of a ship with 12 cargo tanks according to prior art, in which the tanks are not interconnected except for their common connection to a ventilation system (not shown)

FIG. 1 shows schematically a tank ship with 12 cargo tanks arranged to be filled (loaded) with oil in the traditional way, with individual displacement of tank atmosphere from each tank being loaded, to the common ventilation system. Piping is omitted for the sake of simplicity.

Dotted lines indicate that the tanks are considered belonging to six pairs; P1-P6 of tanks. The tanks belonging to a common pair are normally filled in parallel, i.e., at the same time.

Figure 2:
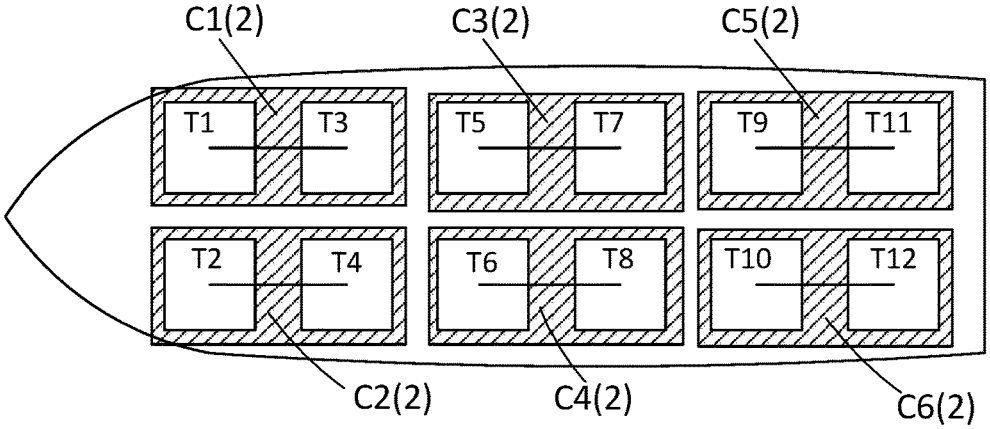
FIG. 2 is a schematic top view of a ship with 12 cargo tanks in which the tanks are arranged in six clusters of two tanks each.

FIG. 2 shows schematically a tank ship with 12 tanks arranged as six clusters of two tanks each, where each cluster of tanks is arranged to be filled according to an embodiment as further described below. Piping is omitted except for a symbolic illustration of vapour connections between the tanks of each cluster. It is important to note the difference between pairs of tanks and clusters of tanks. The first pair of tanks consists of tanks T1 and T2 while the first cluster of tanks, when comprising two tanks, consists of tanks T1 and T3.

Figure 3:
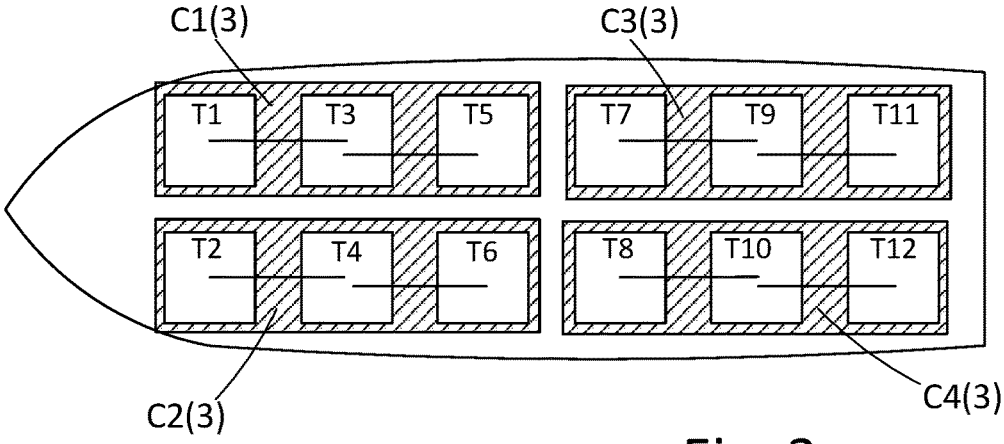
FIG. 3 is a schematic top view of a ship with 12 cargo tanks in which the tanks are connected in four clusters of three tanks each.

FIG. 3 shows schematically a tank ship with 12 tanks arranged as four clusters of three tanks each, where each cluster of tanks is arranged to be filled according to an embodiment as further described below. Piping is omitted except for a symbolic illustration of vapour connections between the tanks of each cluster.

Figure 4A:
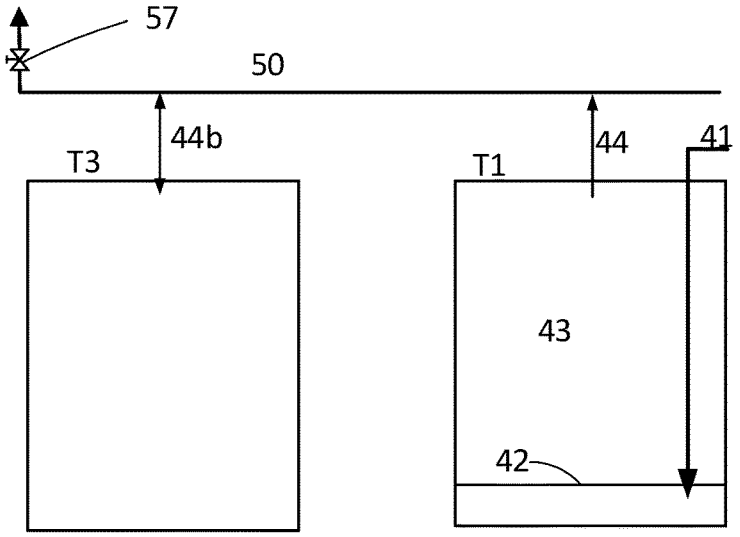
FIG. 4A is a schematic side view of two cargo tanks T1, T3 arranged to be loaded in the traditional manner, i.e., prior art, at an early stage of loading of tank T1.

Now referring to FIG. 4A which shows, schematically, early loading of a tank T1 though oil supply conduit 41, according to prior art technology. The oil level 42 in the tank is quite low and a substantial volume 43 above the oil surface is available for inert gas and oil vapour. At this early stage of loading the concentration of oil vapour in the ventilation pipe 44, which leads to the common ventilation pipe 50 is low or moderate. However, as the loading continues, available volume 43 is reduced, and concentration of oil vapour in both available volume 43 and ventilation pipe 44 increases due to vaporization from the oil. A ventilation pipe 44*b* between tank T3 and the common ventilation pipe 50, has the same general function as ventilation pipe 44 from tank T1. With reference also to FIG. 1, it should be understood that tank T2 is filled simultaneously with tank T1 and with the same general displacement of vapour therefrom as described with reference to tank T1. Every two tanks laterally adjacent to one another are typically filled simultaneously.

The common ventilation pipe 50 is typically provided with a throttle valve 57 near the outlet (i.e., ventilation mast), a.o., to allow the build-up and maintenance of a slight overpressure in the entire system of tanks.

Figure 4B:
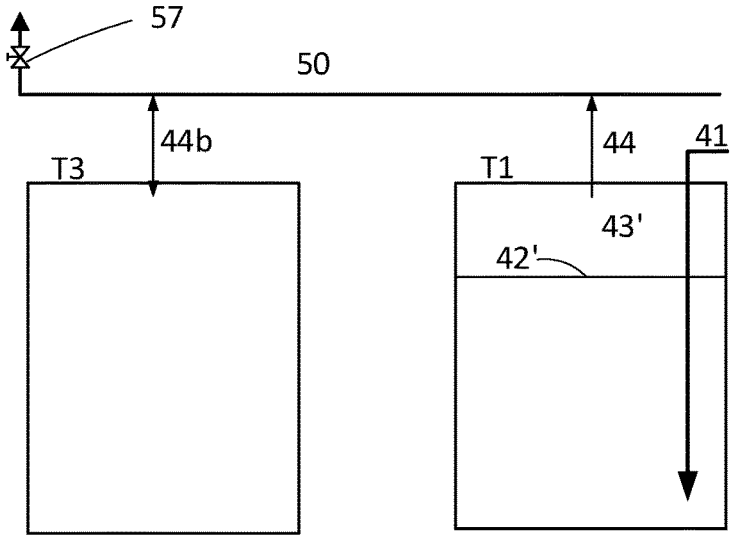
FIG. 4B is a view according to FIG. 4A at a later stage of loading of tank T1.

Now referring to FIG. 4B, when an oil level 42' has been reached, the loading and vaporization has been going on for a while and the available volume 43' for the vapour is about ¼ compared with start-up. At this point in time, oil vapour concentration in the available volume 43', ventilation pipe 44 and the common ventilation pipe 50 has increased, and may also have increased significantly depending on quality of the loaded oil. During the process here described, nothing has been going on in relation to tank T3, with the exception that some of the vapour transported through the common ventilation pipe 50 may have side-flowed into tank T3 through ventilation pipe 44*b*.

For each pair of cargo tanks being loaded, there is a rather quick build-up of VOC concentration from a low concentration to a high concentration. The denotation "pair of tanks" used here refers to two tanks arranged laterally adjacent to one another and does not refer to the cluster of tanks being the core of the disclosed embodiments.

In practice, in considerations of ship stability and ship strength, the cargo tanks are not filled in a sequence from the front of the ship to the aft of the ship. A more typical sequence, for a ship of six pairs of tanks, arranged in six clusters as shown in FIG. 2, is as follows; first the odd numbered pairs of tanks, i.e., pairs P1, P3, and P5 are typically filled in parallel, thereafter the even numbered pair of tanks, pairs P2, P4, and P6 are filled in parallel. Thus, the filling is conducted in a two-stage process in each of which six tanks, three pairs of tanks, are filled simultaneously. The six tanks, or three pairs of tanks being filled in parallel may be denoted a set of tanks. Thus, tanks T1, T2, T5, T6, T9, and T10 constitute one set of tanks, while tanks T3, T4, T7, T8, T11, and T12 constitute another set of tanks, still within the framework of FIG. 2.

In a configuration as shown in FIG. 3, in which each cluster comprises three tanks each, the filling sequence could be pair P1 and pair P4 in parallel, then pair P2 and pair P5 in parallel, and finally, pair P3 and pair P6 in parallel. In this case, there would thus be three sets of tanks, tanks T1, T2, T7, and T8 belonging to the first set, tanks T3, T4, T9, and T10 belonging to the second set, and tanks T5, T6, T11, and T12 belonging to the third set of tanks.

For the sake of exemplification, with regard to the vapour displaced from the tanks, we now focus on the filling of tank T3 since tank T3 is the one clustered with tank T1.

Figure 4C:
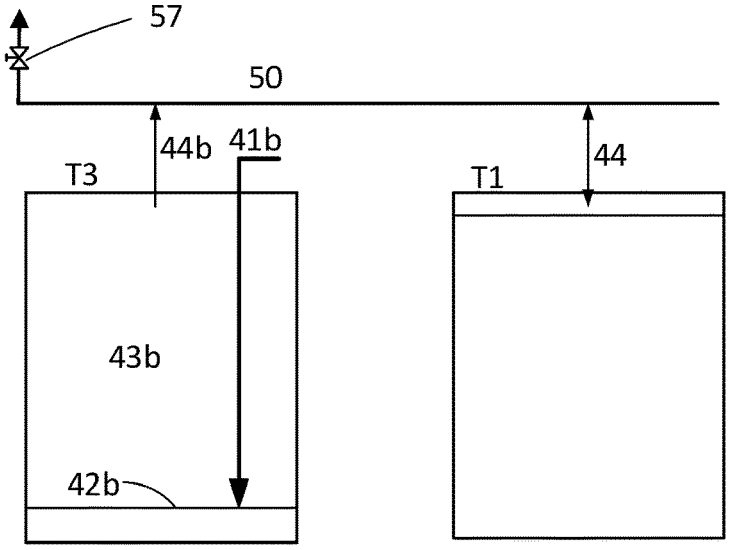
FIG. 4C is a view according to FIGS. 4A and 4B at an early stage of loading of tank T3.

FIG. 4C illustrates early loading of tank T3 by oil supply conduit 41*b*, which exhibits a progress similar to the one described with reference to FIG. 4A and the early loading of tank T1 with regard to vapour development. Oil level is shown with reference 42*b*, and the available space for vapour as 43*b*. At this stage, the vapour concentration discharged to the common ventilation pipe 50 is low or moderate, but normally a bit higher compared with the situation illustrated by FIG. 4A. It is worth noticing, as illustrated by the arrow 44 in FIG. 4C, that evaporation in tank T1 still contributes to the VOC in pipe 50 after the filling of tank T1 has come to an end.

Figure 4D:
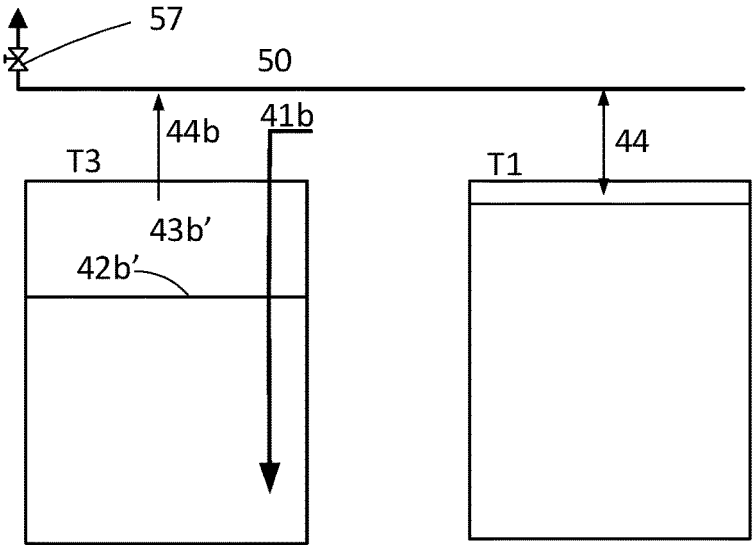
FIG. 4D is a view according to FIGS. 4A-4C at a later stage of loading of tank T3.

FIG. 4D shows the loading of tank T3 at a later stage, where oil level is increased as shown by 42*b*', and the available space for vapour is reduced as shown by 43*b*'. The situation is similar to the one shown in FIG. 4B for tank T1. Concentration of vapour discharged to the common ventilation pipe 50 has increased, and may also have increased significantly depending on quality of the loaded oil.

Figure 4E:
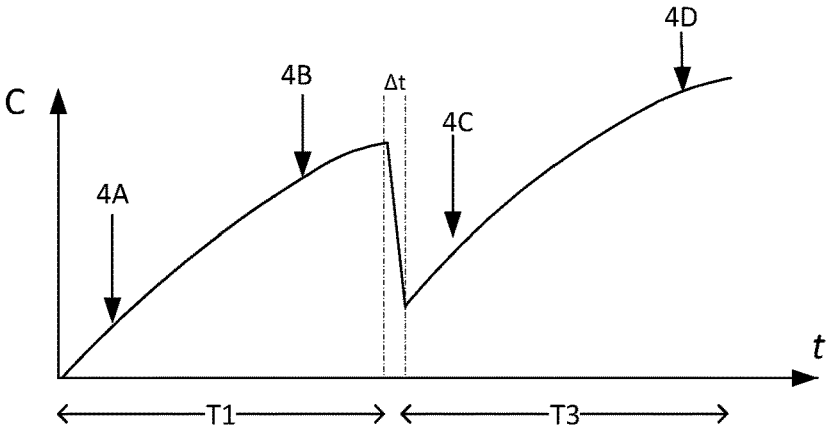
FIG. 4E is a schematic illustration of the VOC concentration in the common ventilation pipe during loading according to FIGS. 4A and 4B and more.

FIG. 4E is a graphic, idealized illustration of the concentration of VOC in the common ventilation pipe 50, caused by vaporization in tanks T1 and T3 during loading of oil to tanks T1 and T3 according to the traditional method. In this example, concentration of VOC at time zero is shown as zero for illustration purposes. In real life this will rarely be the case, as the tanks will contain a varying degree of residual VOC from previous cargoes. However, the general principle will remain the same. As indicated, the concentration level will typically not fall to level zero in the shift prior to start-up of loading tank T3 since some oil vapor from the loading of T1 will normally have side-flowed into tank T3 through the common ventilation pipe 50.

Figure 5A:
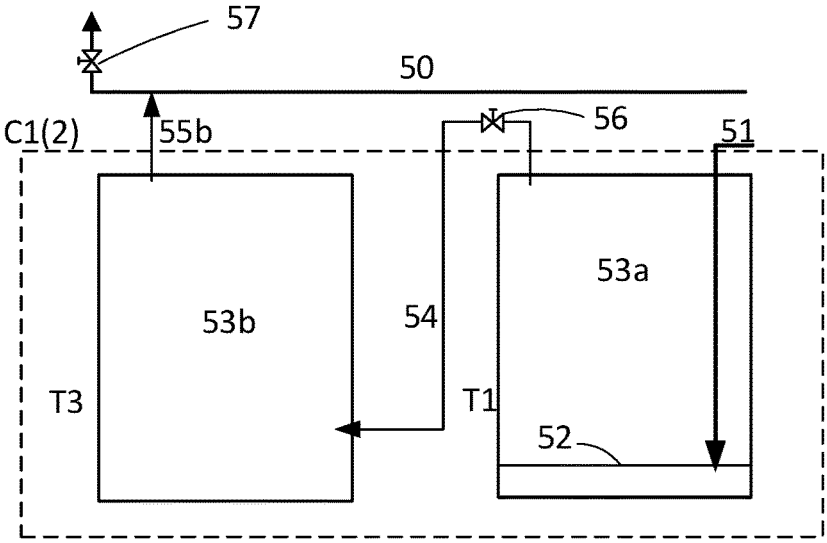
FIG. 5A is a schematic side view of a cluster of two tanks T1, T3 as illustrated by FIG. 2, arranged to be filled in succession at an early stage of loading.

Now turning to FIG. 5A, showing the principle of loading tank T1 when arranged as the first tank of a cluster of two tanks T1, T3. Oil is first loaded to tank T1 through the oil supply pipe 51. The atmosphere in tank T1 is displaced via vapour transfer conduit 54 to tank T3 before leaving tank T3 to the common ventilation pipe 50 through ventilation pipe 55*b*. When tank T1 is nearly empty, as shown in FIG. 5A, the volume available for the vapour, 53*a*+53*b* is twice as large compared to the volume available with the traditional method. As the loading continues, the relative difference between the available volumes of the two methods increases.

It is worth noticing that the vapour transfer conduit 54 is provided with a throttle valve 56 that allows a throttling of the ventilation pipe to increase pressure in the available volume 53*a* of tank T1 during loading, to reduce vaporization from the oil in tank T1. By increasing pressure in tanks receiving cargo only, pressure build-up will occur faster in these tanks, and full effect of increased pressure is achieved earlier.

Figure 5B:
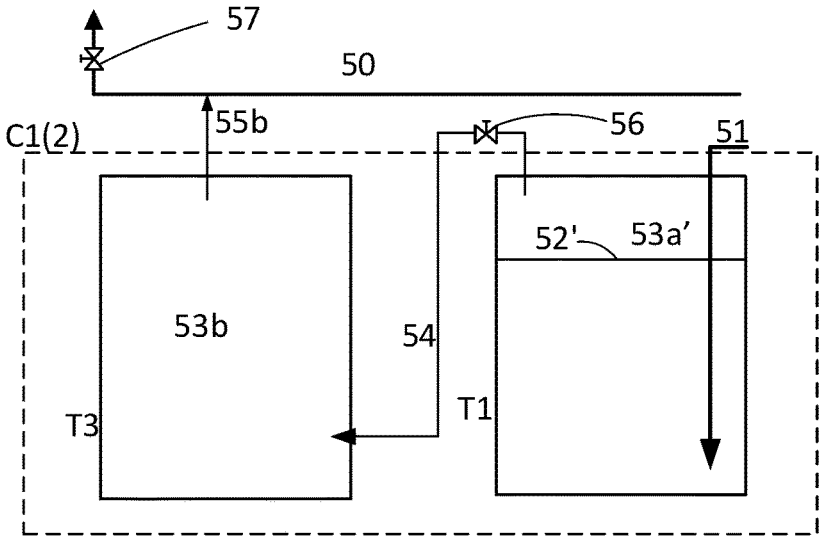
FIG. 5B is a view according to FIG. 5A at a later stage of loading.

Referring to FIG. 5B, when e.g., ¾ of tank T1 is full of oil, the volume 53*a*'+53*b* available for the VOC is 5/4 of a tank volume, while with the method according to prior art as illustrated by FIG. 4B, the volume 43' available is ¼ of a tank volume.

Figure 5C:
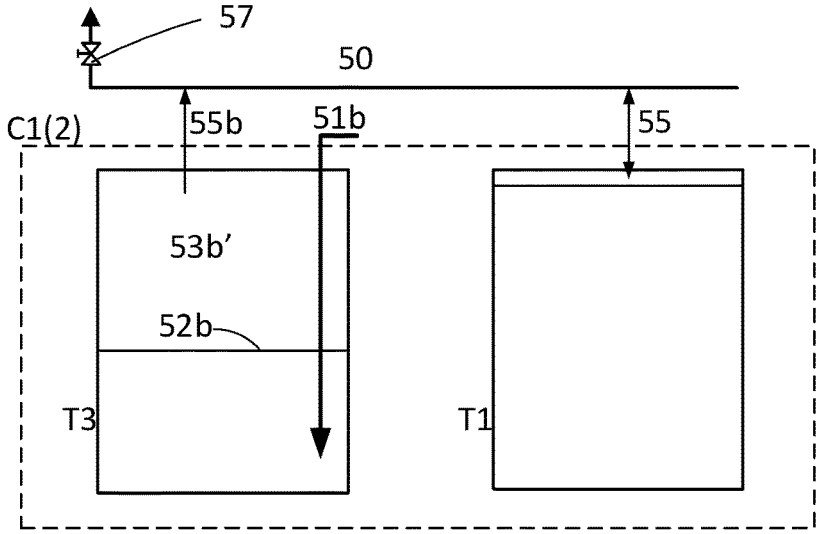
FIG. 5C is a view according to FIGS. 5A and 5B at an even later stage of loading.

Since, with the embodiment of FIGS. 5A-5C, there is at the stage, as shown by FIG. 5B, still 5/4 of tank volume available for the VOC, the highest concentration being near the bottom of tank T3 due to the relatively high density of the VOC compared to the inert gas comprising the remaining part of the tank atmosphere. Thus, the concentration of VOC passing through ventilation pipe 55*b* to the common ventilation pipe 50 at this stage is correspondingly low, and much lower than the concentration of VOC passing through ventilation pipe 44 at the stage shown by FIG. 4B.

Now turning to FIG. 5C, the loading of tank T1 has been completed and the loading of tank T3 has just started. Increased VOC concentration in tank T3 caused by transfer of tank atmosphere from tank T1, the highest concentration being near the bottom of tank T3 due to the high density of VOC, will now significantly reduce vaporization from the oil, and thus reduce overall vaporization from oil loaded to tank T3 compared to oil loaded to tank T1.

As loading of tank T3 continues, development of VOC concentration above the oil level 52*b* will be slower than the development experienced during the loading illustrated in FIGS. 4C and 4D due to a higher initial concentration of VOC. In other words, VOC concentration in ventilation pipe 55*b* continue to increase slow and steady, as when tank T1 was loaded. It is worth noticing, as illustrated by the arrow 55 in FIG. 5C, that evaporation in tank T1 still contributes to the VOC in pipe 50 after the filling of tank T1 has come to an end.

Figure 5D:
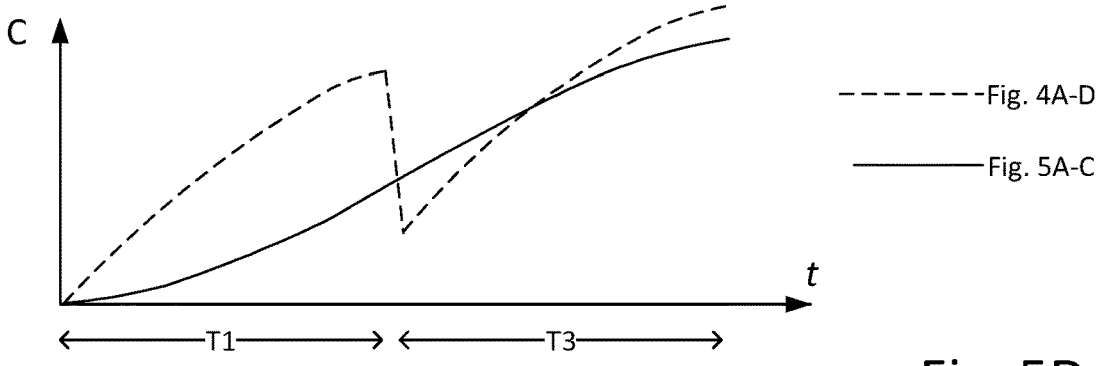
FIG. 5D is a schematic illustration of the contribution to the VOC concentration in the common ventilation pipe during loading according to FIGS. 5A to 5C and more, compared with FIG. 4E.

FIG. 5D is a graphic, idealized illustration of contribution to VOC concentration development in the common ventilation pipe 50 displaced from tanks T1 and T3 during loading of oil to the tanks T1 and T3 according to the embodiment shown in FIGS. 5A-5C, compared to VOC concentration development during loading according to FIGS. 4A-4D (prior art) shown with a broken line. In this example, concentration of VOC at time zero is shown as zero for illustration purposes. In real life this will rarely be the case, as the tanks will contain a varying degree of residual VOC from previous cargoes. However, the general principle will remain the same.

Though described only in relation to the loading of tanks T1 and T3 in FIGS. 5A to 5C, it should be understood that the same general effect is achieved in loading all clusters of tanks.

During loading of tank T1, as illustrated in FIGS. 5A and 5B, the concentration build-up and general level of VOC in tank atmosphere passing to common ventilation pipe 50 through ventilation pipe 55*b* is much lower compared to the prior art method with tank atmosphere passing to common ventilation pipe 50 through ventilation pipe 44. During loading of tank T3 the VOC concentration build-up through ventilation pipe 55*b* will continue, but with less vaporization from the crude caused by increased initial concentration of VOC in T3 due to previous transfer of VOC-saturated tank atmosphere during loading of T1. As a whole, a significant overall reduction in VOC emission is obtained, as illustrated by the different areas below the two curves in FIG. 5D.

Simulations have shown that the herein disclosed method, when displacing the vapour through one adjacent, empty tank, may reduce the amount of oil vapour released by about 10-35% depending on oil quality and level of tank atmosphere mixing compared to the traditional method.

It is feasible to combine three or more tanks according to the same principle, leading to two or more intermediate tanks for the VOC to settle in rather than just one, before entering the common ventilation system.

Figure 6A:
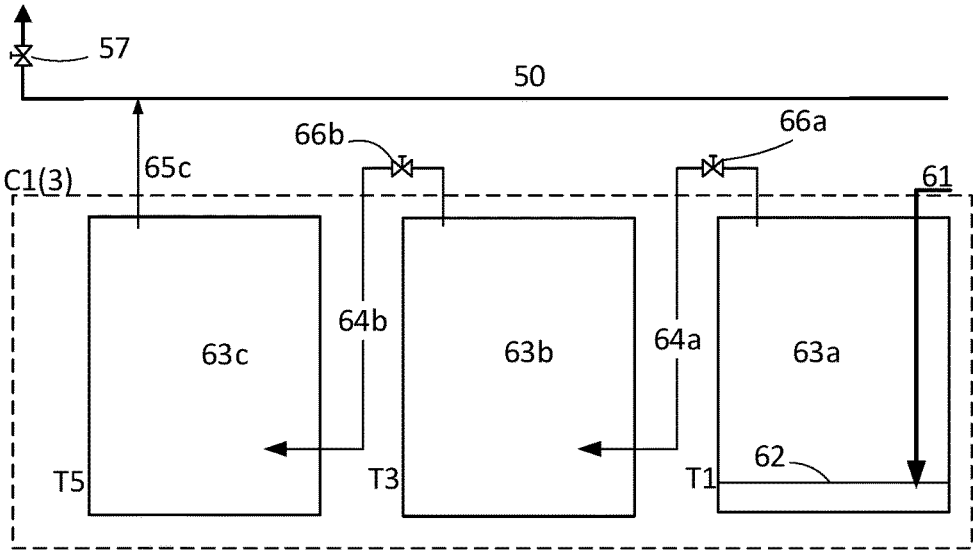
FIG. 6A is a side schematic view of a cluster of three tanks T1, T3, T5.

FIG. 6A is a schematic side view of a cluster CA of three tanks T1, T3, T5 arranged as a three-tank cluster according to FIG. 3, using the same general principle as shown for two tanks in FIGS. 5A to 5C. When oil is loaded trough oil supply pipe 61 to tank T1, in accordance with this embodiment, vapour is displaced through vapour transfer conduit 64*a* to tank T3 and further on from tank T3 to tank T5 through vapour transfer conduit 64*b*, before being displaced to the common ventilation pipe 50 through ventilation pipe 65*c*. Throttle valves 66*a* and 66*b*, respectively, arranged on each of the vapour transfer conduits 64*a*, 64*b*, have the same function as throttle valve 56 shown in FIGS. 5A and 5B. When tank T1 is full, the oil supply conduit 61 is shifted to tank T3. From this point on, development of this embodiment is comparable to the one described with reference to FIGS. 5A to 5C. It should be noted that the connection of three tanks T1 to T3 to a cluster CA does not require that the tanks are linearly arranged, it merely requires that the piping between the tanks is adequately arranged.

Figure 6B:
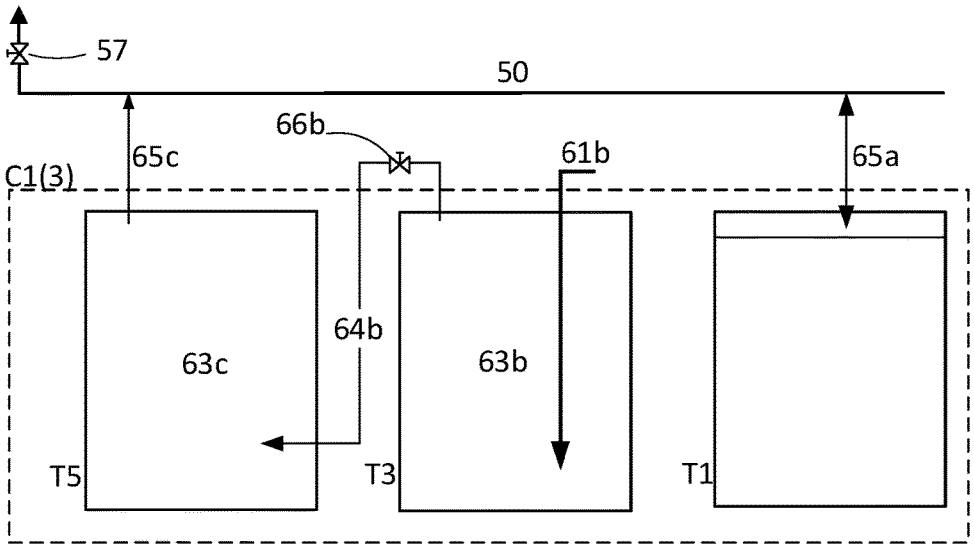
FIG. 6B is a view according to FIG. 6A at a later stage of loading.

FIG. 6B illustrates a situation in which the tank T1 has been filled completely or to the desired degree, and loading of tank T3 has commenced through oil supply pipe 61*b*. At this stage the throttle valve 66*a* would be closed, and a direct connection 65*a* from T1 to 50 re-established.

While obtaining a significant reduction in the VOC concentration during loading of the first tank in the embodiment shown in FIGS. 5A to 5C, a similar reduction is obtained during loading tank T3 as well as of tank T1 in the embodiment of FIG. 6A, i.e., of two thirds of the tanks encountered. As a whole, an even more substantial reduction in VOC emissions is obtainable by increasing the number of tanks in a cluster from two to three.

In combination with all embodiments disclosed herein, individual pressure regulation limited to tanks receiving oil only may be accomplished by throttle valves 66*a* and 66*b* as illustrated in FIG. 6A and by throttle valve 56 as illustrated in FIGS. 5A, 5B, to increase static pressure of available volumes in the tanks during filling. Referring to FIG. 6A, throttle valve 66*a* would be used to increase pressure in T1 (volume 63*a*) with throttle valve 66*b* fully open. Referring to FIG. 6B, throttle valve 66*b* would be used to increase pressure in T3 (volume 63*b*) with throttle valve 66*a* fully closed to isolate the full tank T1 from the cluster. Also referring to FIG. 6B, a throttle valve (57) in the common ventilation mast 50 could be used to increase pressure in T5 and generally in the entire tank and piping system connected to this ventilation mast during filling of T5.

Referring to FIG. 6B, while throttle valve 57 is typically used to set a general overpressure in the entire tank system, local valves, such as throttle valve 66*b*, may be set differently to apply a higher pressure in certain tanks, if desired.

Figure 6C:
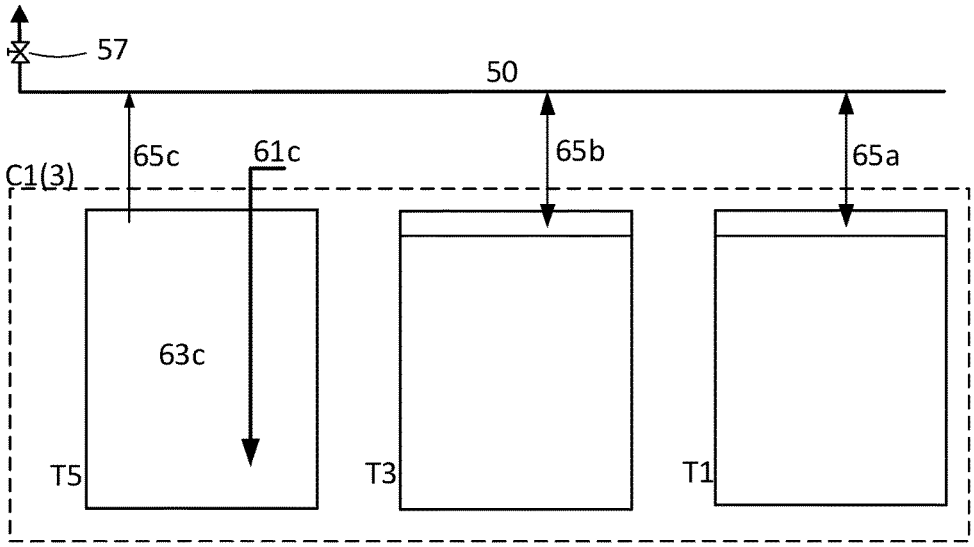
FIG. 6C is a view according to FIGS. 6A and 6B at an even later stage of loading.

FIG. 6C illustrates a situation in which the tanks T1 and T3 have been filled completely or to the desired degree, and loading of tank T5 has commenced through oil supply pipe 61*c*. At this stage, throttle valve 66*b* (not shown) is closed and a direct connection 65*b* from T3 to 50 re-established. Since T5 is the last tank of the cluster and the VOC generated is transferred directly through conduit 65*c*, the VOC concentration in 65*c* is generally higher in this stage than in the two preceding stages.

Figure 7A:
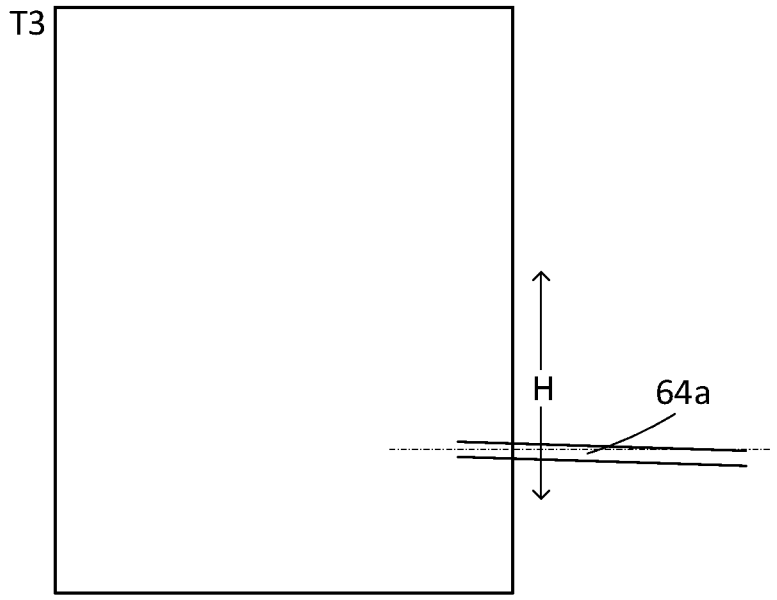
FIG. 7A is a side schematic view of details of tank T3 from FIG. 6A.

FIG. 7A is a slightly enlarged view of tank T3 from FIG. 6, showing the outlet end of the vapour transfer conduit 64*a* for vapour entering tank T3 from tank T1 when filling oil to tank T1. The vapour transfer conduit 64*a* enters the tank T3 horizontally, or with a slight upwards inclination up to maximum 10 degrees. The outlet end of the vapour transfer conduit 64*a* is preferably at an elevation H in the range between 20% and 50% of the height of the tank T3.

Figure 7B:
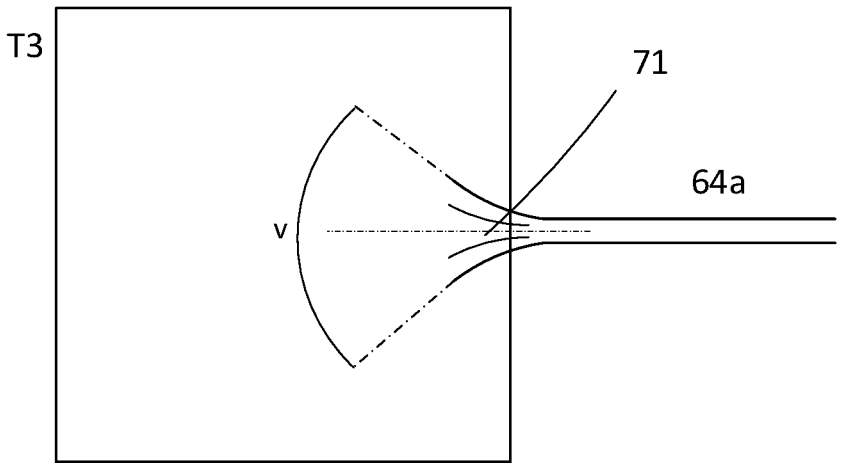
FIG. 7B is a top schematic view of details of tank T3 from FIG. 6A.

FIG. 7B is a top view of the tank T3 of FIG. 7A, showing that the vapour transfer conduit 64*a* is provided with a diffusor element 71 that spreads the vapour horizontally to a fan-shaped flow with very little vertical spread, thereby slowing down the velocity of the flow and allowing the heavier components to find their way downwards in the tank with a minimum of agitation or turbulence, while the lighter components find their way upwards in the tank towards the vapour outlet.

The angular spread of the flow is preferably at least 75 degrees and more preferred more than 90 degrees and may even be up to about 170 degrees, horizontally, while the vertical spread is neglectable, or preferably less than 10 degrees. The diffusor element 71 is preferably symmetrically arranged in relation to a vertical centre axis of the receiving tank.

The vapour transfer conduit 64*a* should preferably be located on or near the longitudinal centre line of the cargo tanks where it is installed (e.g., between T1 and T2) to allow a symmetrical spread of the inflowing vapour. This arrangement will also reduce risk of unintended cargo transfer due to ship movement or damage heel angles, and for the same reason, the highest point of the conduit should also be raised at least one meter above the cargo deck.

While the details of FIGS. 7A and 7B are shown in relation to the cluster of three tanks shown in FIG. 6, the features of FIGS. 7A, 7B are beneficial in relation to all structural embodiments disclosed herein.

Summing up the general properties and features of disclosed embodiments:

All cargo tanks of the present vapour transfer assembly are fluidly connected to a common ventilation pipe.

Preferably all, but at least some of the cargo tanks are grouped into clusters as described and explained above. The clusters preferably exhibit a number of tanks from two to four. Preferably, but not necessarily, every cluster exhibits the same number of tanks.

The vapour transfer assembly typically encounters throttle valves on the conduits transferring vapour between the tanks of a cluster in order to allow a certain individual pressure build-up in each tank during loading to thereby counteract vaporization of the oil.

The advantages of the disclosed embodiments are due to at least three factors The first factor is the benefit of a comparatively large volume in which the VOC is initially distributed, leading to a slower concentration build-up than in a smaller volume. This will significantly reduce the amount of VOC released to the atmosphere when loading the first set of cargo tanks (T1) with reference to FIGS. 5A, 5B, and first two sets of cargo tanks (T1, T3) with reference to FIGS. 6A, 6B.

The second factor is significantly reduced vapour release from oil loaded to cargo tanks in the second tank set (to which T3 belongs) with reference to FIG. 5C, and second and third tank set (T3, T5) with reference to FIG. 6C, caused by increased VOC concentration in the second (and third, where applicable) tank set due to transfer of tank atmosphere from previously loaded tanks in the first (and second, where applicable) tank set.

The third factor is the effect of settlement of the comparatively heavy VOC vapour at the bottom of the second tank (and optionally further tanks), causing the atmosphere leaving the last tank of the clusters to contain a reduced amount of VOC compared to an average concentration based on the amounts vaporized.

In addition, the disclosed embodiments allow a significantly faster static pressure build-up of tank atmosphere in cargo tanks receiving oil. Increasing cargo tank pressure has a well-documented effect on reducing vaporization from the oil, and will contribute to reduce overall emissions. It should generally be acknowledged that while the inventive principle has been described in detail with regard to cargo tanks being arranged two by two, the general principle is applicable with any tank configuration.

The invention claimed is:

1. A vapour transfer assembly for a plurality of tanks connected to a common ventilation pipe, wherein the tanks are oil tanks, comprising:

at least some of the plurality of tanks being grouped into a cluster of tanks that comprises at least two tanks;

a vapour transfer conduit from at least a first tank of said cluster of tanks to a second tank of the said cluster being configured for causing an atmosphere displaced from the first tank of the cluster of tanks to move through at least the second tank of said cluster of tanks prior to entering the common ventilation pipe, thereby slowing a build-up of concentration of volatile organic compounds (VOC) in the atmosphere entering the common ventilation pipe, wherein the vapour transfer conduit enters the second tank of said cluster at a height that is within a range of 20-50% of a height of the second tank.

2. The vapour transfer assembly of claim 1, wherein all of the tanks connected to the common ventilation pipe are grouped into clusters of tanks with each cluster having at least two tanks.

3. The vapour transfer assembly of claim 1, wherein the cluster of tanks has three or four tanks.

4. The vapour transfer assembly of claim 1, wherein the vapour transfer conduit includes a throttle valve configured to allow a predetermined pressure build-up in the first tank, whereby a vaporization of oil is counteracted.

5. The vapour transfer assembly of claim 1, wherein the cluster comprises plural clusters each utilizing a vapour transfer conduit that includes a throttle valve.

6. The vapour transfer assembly of claim 1, wherein the vapour transfer conduit enters the second tank horizontally or at a slight upwards inclination of up to 10 degrees.

7. The vapour transfer assembly of claim 1, wherein the vapour transfer conduit includes a diffusor element at an outlet end and the diffusor element is arranged symmetrically in relation to a vertical center axis of the second tank.

8. The vapour transfer assembly of claim 1, wherein the plurality of oil tanks are arranged on an oil tanker.

9. The vapour transfer assembly of claim 1, wherein the vapour transfer conduit includes a diffusor element at an outlet end configured to spread a flow of vapour into a substantially horizontal fan-shaped flow.

10. The vapour transfer assembly of claim 9, wherein the diffusor element is arranged to spread the flow about a spread angle of at least 75 degrees.

11. The vapour transfer assembly of claim 9, wherein the diffusor element is arranged to spread the flow about a spread angle of at least 90 degrees.

12. A vapour transfer assembly for a plurality of oil tanks connected to a common ventilation pipe, comprising:

at least some of the plurality of oil tanks being grouped into a cluster of tanks that comprises at least two tanks;

a vapour transfer conduit from at least a first tank of said cluster of tanks to a second tank of the said cluster being configured for causing an atmosphere displaced from the first tank of the cluster of tanks to move through at least the second tank of said cluster of tanks prior to entering the common ventilation pipe, thereby slowing a build-up of concentration of volatile organic compounds (VOC) in the atmosphere entering the common ventilation pipe, wherein the vapour transfer conduit includes one of:

a throttle valve configured to allow a predetermined pressure build-up in the first tank, whereby a vaporization of oil is counteracted; or a diffusor element at an outlet end configured to spread a flow of vapour into a substantially horizontal fan-shaped flow.

13. A method for filing a plurality of oil tanks connected to a common ventilation pipe and allow atmosphere to be displaced from the plurality of the oil tanks and avoid excessive pressure build-up, comprising:

grouping at least some the oil tanks into a cluster of tanks having at least two tanks; and connecting a vapour transfer conduit from a first tank of the cluster to a second tank of the cluster, said vapour transfer conduit allowing the atmosphere displaced from the first tank to move through at least the second tank prior to entering the common ventilation pipe and slowing a build-up of concentration volatile organic compounds (VOC) in the atmosphere entering the common ventilation pipe, wherein the vapour transfer conduit enters the second tank at a height that is within a range of 20-50% of a height of the second tank.

* * * * *